US006286291B1

(12) United States Patent
Tale' et al.

(10) Patent No.: US 6,286,291 B1
(45) Date of Patent: Sep. 11, 2001

(54) METHOD AND MACHINE FOR WRAPPING A PRODUCT

(75) Inventors: Fabrizio Tale'; Mario Spatafora, both of Bologna (IT)

(73) Assignee: G.D Societa' per Azioni, Bologna (IT)

( * ) Notice: Subject to any disclaimer, the term of this patent is extended or adjusted under 35 U.S.C. 154(b) by 0 days.

(21) Appl. No.: 09/345,134

(22) Filed: Jul. 6, 1999

(30) Foreign Application Priority Data

Jul. 14, 1998 (IT) ..... BO98A0426

(51) Int. Cl.[7] ..... B65B 19/14; B65B 47/06

(52) U.S. Cl. ..... 53/456; 53/466; 53/579; 53/234

(58) Field of Search ..... 53/466, 575, 578, 53/579, 234, 456

(56) References Cited

U.S. PATENT DOCUMENTS 2,603,047 * 7/1952 Malhiot ..... 53/579
3,978,639 * 9/1976 Ferrozzi ..... 53/234
4,085,568 * 4/1978 Focke ..... 53/234
4,823,536 * 4/1989 Manservigi ..... 53/466
5,299,679 * 4/1994 Obara ..... 53/149
5,373,681 * 12/1994 Shigeta ..... 53/234
5,392,586 * 2/1995 Imai ..... 53/234

FOREIGN PATENT DOCUMENTS 0509293 10/1992 (EP) .
0548978 6/1993 (EP) .

* cited by examiner

*Primary Examiner*—John Sipos
(74) *Attorney, Agent, or Firm*—Ladas & Parry

(57) ABSTRACT

A method and machine for wrapping a product in a sheet of wrapping material, whereby a wrapping head is fed along a wrapping path, along a first portion of which, the wrapping head is positioned perpendicular with respect to the wrapping path to receive the sheet of wrapping material and the product, about which the sheet of wrapping material is folded to form a tubular wrapping having two opposite open ends; along a second portion of the wrapping path, the wrapping head is positioned parallel to the wrapping path so as to cooperate, as the wrapping head travels along the wrapping path, with a fixed folding device for folding the aforementioned open ends.

15 Claims, 2 Drawing Sheets

METHOD AND MACHINE FOR WRAPPING A PRODUCT

The present invention relates to a method of wrapping a product.

BACKGROUND OF THE INVENTION

In the following description, specific reference is made, purely by way of example, to the packing industry, and in particular to cigarette packing machines for producing packets of cigarettes.

Known cigarette packing machines comprise a wrapping wheel powered to rotate about a central axis and having a number of wrapping heads equally spaced about the central axis. As it rotates, the wheel feeds each head along a wrapping path through a supply station where the head receives a sheet of wrapping material and a respective product, about which the sheet of wrapping material is folded into a U; through a first folding station where the sheet of wrapping material is folded to form about the product a tubular wrapping having two opposite open ends; and through a second folding station equipped with a folding device having a pair of movable folding elements, each cooperating with the head to fold a respective open end.

On step-operated packing machines of the above type, each wrapping head is located, with respect to the wrapping wheel, in a fixed radial position with respect to the central axis of rotation of the wheel.

On continuous packing machines of the above type, each wrapping head oscillates, in use, in the neighborhood of a radial position with respect to the central axis of rotation of the wheel, so as to keep the head facing the supply station and/or a folding tool long enough to complete the relative operation.

Packing machines of the above type are relatively expensive, on account of the movable folding elements for folding the open ends of the tubular wrapping, which are fairly complicated to produce, especially in the case of a continuous packing machine.

SUMMARY OF THE INVENTION

It is an object of the present invention to provide a method of wrapping a product, designed to eliminate the aforementioned drawback, and which is therefore straightforward and cheap to implement.

According to the present invention, there is provided a method of wrapping a product in a sheet of wrapping material, the method comprising the steps of feeding a wrapping head along a wrapping path; supplying the wrapping head with said sheet of wrapping material and said product along a first portion of the wrapping path; folding the sheet of wrapping material about the product along the first portion of the wrapping path to form a tubular wrapping having two opposite open ends; and folding the opposite open ends of the tubular wrapping along a second portion of the wrapping path; the method being characterized by comprising the further step, along the second portion of the wrapping path, of positioning the wrapping head substantially parallel to the wrapping path, so as to cooperate, as the wrapping head is fed along the wrapping path, with a fixed folding device for folding said open ends.

The present invention also relates to a machine for wrapping a product.

According to the present invention, there is provided a machine for wrapping a product in a sheet of wrapping material, the machine comprising a wrapping head for receiving and retaining said sheet of wrapping material and said product; a conveyor for feeding the wrapping head along a wrapping path; a supply station located along a first portion of the wrapping path to supply the wrapping head with said sheet of wrapping material and said product; a first folding station located along a first portion of the wrapping path to fold the sheet of wrapping material about the product and form a tubular wrapping having two opposite open ends; and a second folding station located along a second portion of the wrapping path to fold the opposite open ends of the tubular wrapping; and being characterized by comprising a fixed folding device for folding the open ends and located at the second folding station; and first actuating means for positioning the wrapping head substantially parallel to the wrapping path along the second portion of the wrapping path, so that the wrapping head cooperates with the fixed folding device as the wrapping head travels along the wrapping path.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
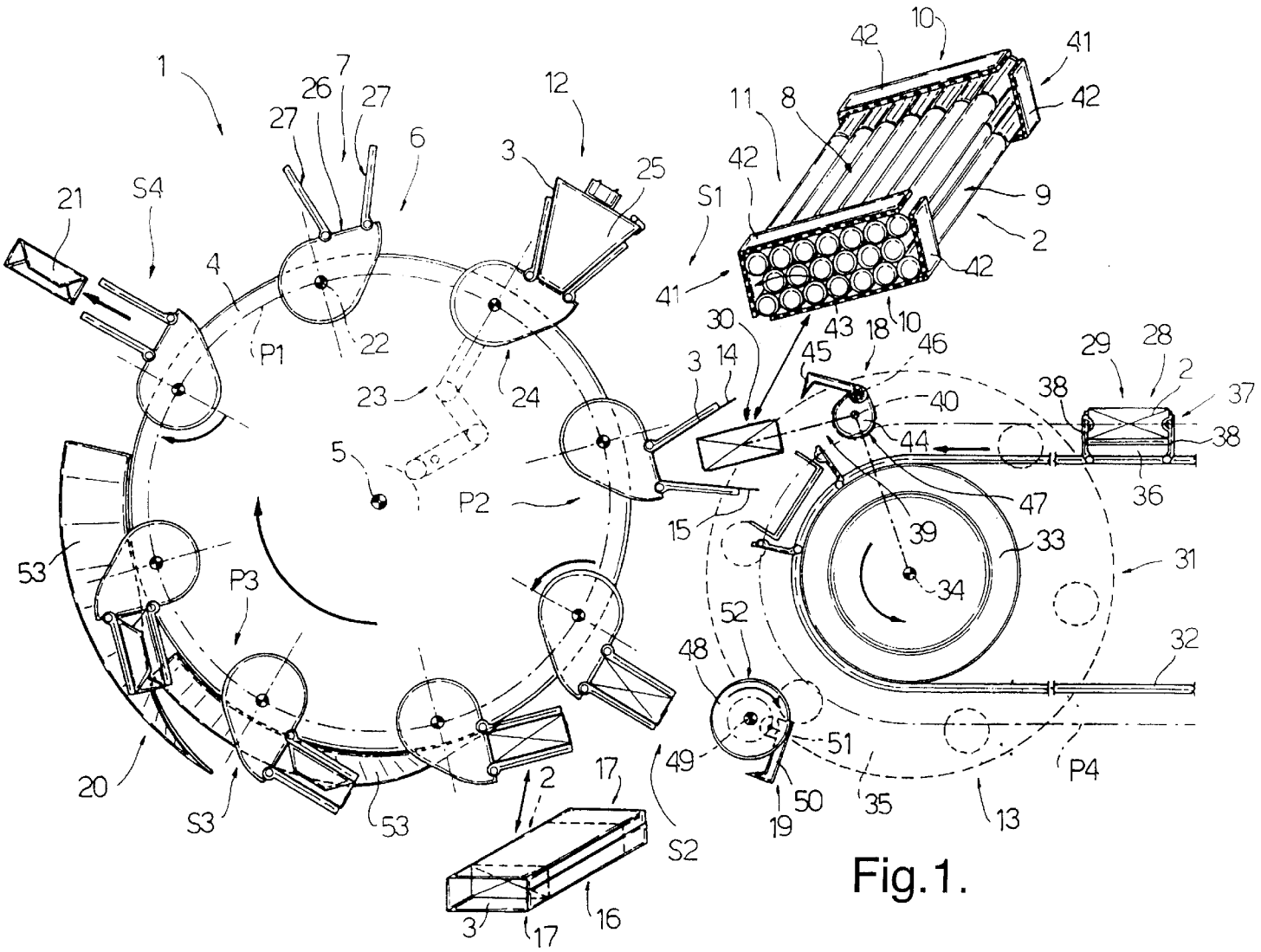
FIG. 1 shows a schematic partial front view, with parts removed for clarity, of a preferred embodiment of the machine according to the present invention.

Number 1 in FIG. 1 indicates as a whole an automatic cigarette packing machine for producing packets (not shown) of cigarettes, and in which a group 2 of cigarettes is first wrapped in a sheet 3 of foil wrapping material and then inserted into a blank (not shown) which is folded about group 2 of cigarettes to form a packet (not shown) of cigarettes.

Packing machine 1 comprises a wrapping wheel 4 rotating continuously (clockwise in FIG. 1) about a central axis 5 perpendicular to the FIG. 1 plane, and having peripheral wrapping heads 6 equally spaced about axis 5 and which are fed along a closed, substantially circular wrapping path P1 as wheel 4 rotates about axis 5. In each head 6 there is defined a seat 7 for first receiving and conveying a respective sheet 3 of wrapping material folded substantially into a U, and subsequently also a respective group 2 of cigarettes which is wrapped in sheet 3 of wrapping material.

Each group 2 of cigarettes is confined within a substantially parallelepiped space defined by a pair of parallel major lateral surfaces 8 and a pair of parallel minor lateral surfaces 9 perpendicular to surfaces 8. Said space also comprises two opposite longitudinal ends 10, and a central portion 11 interposed between said two longitudinal ends 10.

A first portion P2 of path P1 extends through a supply station S1 having a known supply unit 12 (shown only partly) for supplying seat 7 of each head 6 with a respective sheet 3 of wrapping material, which is folded into a U inside seat 7. Station S1 also comprises a further supply unit 13 located downstream from unit 12 in the traveling direction of wrapping heads 6 along path P1, and which provides for supplying seat 7 of each head 6 with a respective group 2 of cigarettes, which is inserted inside the respective U-folded sheet 3 of wrapping material, which, once group 2 is inserted, has two facing wings 14 and 15 projecting transversely from group 2.

First portion P2 of path P1 also extends through a folding station S2 where wings 14 and 15 of sheet 3 of wrapping material are folded through 90° onto group 2 and one onto the other to form a tubular wrapping 16 having two opposite open ends 17. More specifically, wing 14 is folded through 90° onto group 2 by a folding device 18 fed along a portion of path P1 extending through station S2, and wing 15 is folded through 90° onto group 2 and partly onto wing 14 by a folding device 19 located in a fixed position with respect to wheel 4.

A second portion P3 of path P1, downstream from first portion P2, extends through a folding station S3 where the opposite open ends 17 of tubular wrapping 16 are folded onto group 2 by a folding device 20, located in a fixed position with respect to wheel 4, to complete the folding of sheet 3 of wrapping material about group 2 and so form a closed wrapping 21.

Finally, wrapping path P1 extends through an unloading station S4 where wrappings 21 are extracted successively from respective seats 7 on wrapping wheel 4 and fed to known follow-up wrapping units (not shown) on machine 1.

Each wrapping head 6 is hinged to wheel 4 and is oscillated, with respect to wheel 4, about an axis 22 parallel to axis 5 by a known cam and rocker arm actuating device 23, of which respective wrapping head 6 defines the central portion of an end rocker arm 24 having an arm defined by respective seat 7.

Actuating device 23 provides for positioning head 6 substantially perpendicular to wrapping path P1 along first portion P2 of path P1. More specifically, actuating device 23 provides for oscillating each wrapping head 6 about respective axis 22 and in the neighborhood of a perpendicular position of seat 7 with respect to path P1 as head 6 is fed through stations S1 and S2, so as to cooperate with supply units 12 and 13 and with folding device 19.

Actuating device 23 also provides for setting head 6 in a fixed position in which seat 7 is proximate and substantially parallel to wrapping path P1 along second portion P3 of path P1 as shown in FIG. 1, so that head 6 cooperates along path P1 with folding device 20.

Supply unit 12 comprises a transfer wheel (not shown) powered to rotate continuously about a fixed central axis (not shown) parallel to axis 5, and having peripheral, substantially trapezoidal folding spindles 25 (only one shown). Each folding spindle 25 provides for withdrawing a respective sheet 3 of wrapping material from a known supply unit (not shown) , and for feeding the sheet 3 of wrapping material, folded into a U, into a respective seat 7 at supply station S1. During insertion of sheet 3 of wrapping material, respective spindle 25 and seat 7 act like a punch and die respectively, and provide for optimum U-folding of sheet 3 of wrapping material inside seat 7.

Seat 7 of each head 6 is defined by a bottom wall 26 fixed with respect to head 6, and by two lateral walls 27, which are hinged on opposite sides of wall 26 and oscillated, about respective axes parallel to axis 22, between an open position and a closed position by a known cam control device (not shown). In the open position, the two lateral walls 27 of each seat 7 form an obtuse angle with bottom wall 26, and seat 7 has a section in the form of an isosceles trapezium negatively reproducing the shape of folding spindles 25; and, in the closed position, the two lateral walls 27 of each seat 7 form a substantially right angle with bottom wall 26, and seat 7 has a rectangular section of substantially the same size as a group 2 of cigarettes so as to engage group 2 completely, i.e. by both central portion 11 and longitudinal ends 10.

The inner surfaces of walls 26 and 27 have a series of holes (not shown) connected to a known suction device (not shown) on wrapping wheel 4.

Supply unit 13 comprises a continuous conveyor 28 (shown partly) for feeding a number of seats 29 along a path P4 through a known loading station (not shown) where a group 2 of cigarettes is formed in or transferred to a respective seat 29 (in known manner not shown), and through supply station S1 where group 2 of cigarettes is transferred from seat 29 to a respective seat 7 by a further movable seat 30, which is carried by a transmission pulley 31 of conveyor 28 and provides for removing group 2 from seat 29 and feeding group 2 to seat 7.

Conveyor 28 comprises a known flexible toothed belt 32 (shown partly in FIG. 1) which is fed along path P4 by pulley 31, which comprises a toothed central roller 33 rotating continuously (anticlockwise in FIG. 1) about a central axis 34 parallel to axis 5, and two flanges 35 (only one shown in FIG. 1) coaxial with axis 34.

Conveyor 28 also comprises a number of bodies 36 supported by and equally spaced along belt 32. In each body 36 is defined a respective seat 29, which has a longitudinal dimension (perpendicular to the FIG. 1 plane) smaller than that of group 2, and a rectangular section of substantially the same transverse dimensions as a group 2 so as to engage group 2 by central portion 11, leaving respective longitudinal ends 10 substantially free.

Each body 36 is provided with a retaining device 37 comprising two jaws 38 integral with belt 32 and which oscillate between a gripping position along the straight portions of belt 32, and a release position along the curved portions (only one shown) of belt 32.

The two flanges 35 (only one shown in FIG. 1) support, in between, a number of peripheral heads 39 (only one shown in FIG. 1) equally spaced about axis 34 and mounted for rotation about respective axes 40 parallel to axis 34. Each head 39 comprises two gripping devices 41 which together define a respective seat 30 for engaging a respective group 2 by respective ends 10.

Each gripping device 41 comprises two relatively thin L-shaped sections 42 lying in the same plane perpendicular to axis 40, and which are movable, with respect to each other and in said plane, between a release position and a gripping position (shown in FIG. 1) in which sections 42 define a tubular seat 43 having an axis parallel to axis 34 and a rectangular section approximately equal to but no larger than the cross section of group 2.

Each head 39 is provided with a known cam and rocker arm control and actuating device (not shown) housed between the two flanges 35 and which, as pulley 31 rotates about axis 34, provides for controlling the angular position of seat 30 about axis 40 and between a loading position, in which seat 30 coincides with a respective seat 29 to withdraw a group 2 of cigarettes from seat 29, and an unloading position, in which seat 30 coincides with a respective seat 7 to transfer group 2 of cigarettes to seat 7.

The cam and rocker arm control and actuating device also controls the position and configuration of each gripping device 41 between an open position, in which the two tubular seats 43 of the same head 39 are separated by a distance greater than the length of a respective group 2 of cigarettes, and a closed position, in which the two tubular seats 43 of the same head 39 define respective seat 30 and grip a respective group 2 of cigarettes by ends 10.

Each head 39 comprises a respective folding device 18, which in turn comprises a roller 44 mounted for rotation between flanges 35 to oscillate about respective axis 40 with respect to flanges 35 and respective gripping devices 41. Each roller 44 supports in rotary manner a folding tool 45, which is oscillated, with respect to roller 44, about an axis 46 parallel to axis 40 by a known epicyclic control device 47, which also controls oscillation of roller 44 about axis 40.

Folding device 19 comprises a roller 48 powered to rotate continuously about an axis 49 parallel to axis 5, and supporting in rotary manner a folding tool 50, which is oscillated, with respect to roller 48, about an axis 51 parallel to axis 49 by a known epicyclic control device 52.

Folding device 20 comprises a pair of fixed helical folding elements 53 parallel to and on either side of wrapping path P1 to engage and fold respective ends 17 of each tubular wrapping 16 as the respective wrapping head 6 travels along path P1.

Operation of machine 1 will now be described with reference to one wrapping head 6, and as of the instant in which head 6 leaves unloading station S4 and is fed, by wheel 4 rotating about axis 5, towards supply station S1.

As already stated, along first portion P2 of wrapping path P1, actuating device 23 sets and maintains wrapping head 6 in a position substantially crosswise to path P1.

As head 6 is fed through supply station S1, seat 7 is moved into said open position, and a respective spindle 25 of supply unit 12 supplies, as described previously, a respective sheet 3 of wrapping material, which is folded into a U inside seat 7 and retained inside seat 7 by said suction device (not shown).

Supply unit 13 then supplies seat 7 with a respective group 2 of cigarettes, which is inserted inside respective sheet 3 of wrapping material, the two wings 14 and 15 of which, once group 2 is inserted, are positioned facing each other and projecting transversely from group 2.

To supply group 2 to seat 7, gripping devices 41 of respective seat 30 are set to said open and release positions, and seat 30 is oscillated about respective axis 40 to move into and maintain, for a given length of time, a position substantially coincident with a respective seat 29 and in which gripping devices 41 of seat 30 are moved into said closed and gripping positions to grip the group 2 of cigarettes carried by seat 29. At the same time, the curve in path P4 moves retaining device 37 of seat 29 into said release position so that group 2 of cigarettes is left under the control of seat 30.

At this point, seat 30 is rotated about its own axis 40 to extract group 2 of cigarettes from seat 29 and feed group 2 to seat 7 which, as wrapping wheel 4 rotates continuously, is traveling through supply station S1 with lateral walls 27 in said open position, and with sheet 3 of wrapping material folded into a U inside.

Seat 7 and seat 30 are oscillated about respective axes 22 and 40 to move into and maintain, for a given length of time, a substantially coincident position, in which lateral walls 27 of seat 7 are moved into said closed position to grip group 2 of cigarettes and at the same time complete the folding of sheet 3 of wrapping material into a U about group 2 of cigarettes.

For a given length of time, seat 7 engages, with sheet 3 of wrapping material in between, both group 2 of cigarettes and sections 42 of gripping devices 41 of seat 30, which is made possible by the thinness of sections 42.

Once group 2 of cigarettes is gripped by seat 7, gripping devices 41 of seat 30 are moved into said open position, so that sections 42 release group 2 of cigarettes by being withdrawn longitudinally with respect to group 2, while still in said gripping position.

Figure 2A:
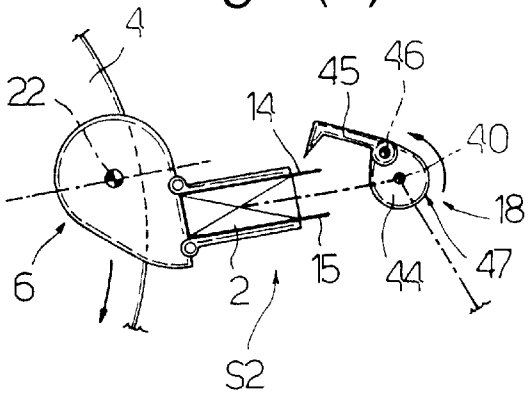
FIGS. 2*a* and 2*b* shows a detail of FIG. 1 in two different operating positions.
Figure 2B:
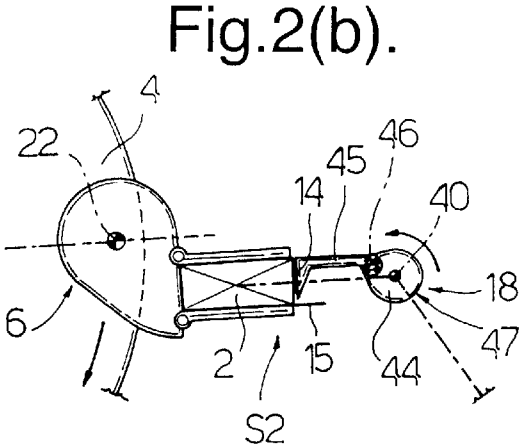

As shown in FIG. 2, simultaneously with release of group 2 by sections 42, control device 47 activates respective folding device 18 to oscillate respective roller 44 with respect to axis 40 so that respective folding tool 45 folds wing 14 of sheet 3 of wrapping material through 90° onto group 2.

Upon completion of the above release and folding operations, seats 30 and 7 move out of said substantially coincident position; seat 30 is restored to the initial position; and seat 7 is fed through folding station S2 by wheel 4 rotating about axis 5.

Figure 3A:
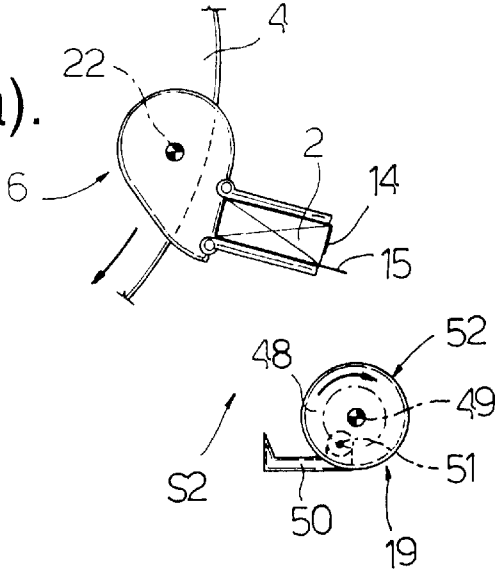
FIGS. 3*a* and 3*b* shows a further detail of FIG. 1 in two different operating positions.
Figure 3B:
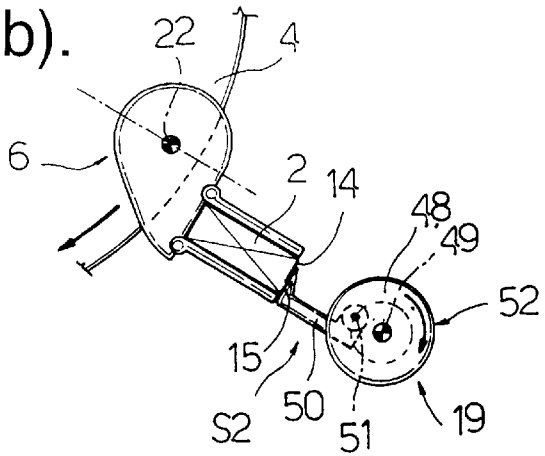

As shown in FIG. 3, as seat 7 travels through folding station S2, the rotation of roller 48 about axis 49 and the simultaneous oscillation of folding tool 50 about axis 51 cause tool 50 to fold wing 15 of sheet 3 of wrapping material through 90° onto group 2 and partly onto the already folded wing 14 to complete the formation of tubular wrapping 16.

Once the above folding operation is completed, wrapping head 6 is fed along second portion P3 of wrapping path P1 and, as stated, is set to and maintained in a fixed position substantially parallel to path P1 by actuating device 23.

As seat 7 of wrapping head 6 is fed through folding station S3, the opposite ends 17 of tubular wrapping 16 are engaged by respective folding elements 53 which, as seat 7 travels along path P1, fold ends 17 onto group 2 to complete the formation of wrapping 21.

Finally, seat 7 is fed through unloading station S4 where wrapping 21 is extracted from seat 7 and fed to known follow-up wrapping units (not shown) of machine 1. The above operations are repeated cyclically.

In an alternative embodiment not shown, each folding device 18 is associated in known manner with a respective head 6, and comprises a folding arm hinged to head 6 and oscillated about axis 22 by a cam device.

In a further embodiment not shown, heads 6 are carried by a conveyor and fed along a substantially straight path P1.

What is claimed is:

1. A method of wrapping a cigarette group in a sheet of wrapping material, the method comprising the steps of:

continuously feeding a wrapping head along a wrapping path having first and second portions, said wrapping head having a seat with a bottom wall and opposed lateral walls for a cigarette group and positioning said seats so that said lateral walls are substantially perpendicular to the wrapping path along said first portion to receive said cigarette group therein;

supplying said seat with said sheet of wrapping material and said cigarette group along said first portion such that said sheet of wrapping material is fed to said wrapping head so as to be folded into a U inside said seat, and at least one said cigarette group is successively fed to said seat so as to be inserted inside said U-folded sheet of wrapping material;

folding said sheet of wrapping material about said cigarette group along said first portion so as to form a tubular wrapping about said cigarette group, said tubular wrapping having two opposite open ends; positioning said seats in said second portion so that said lateral walls are substantially parallel to said wrapping path and feeding said seat through a fixed folding device along said second portion, thereby folding said opposite open ends of said tubular wrapping against said cigarette group along said second portion of said wrapping path.

2. The wrapping method of claim 1 further comprising the step of oscillating said wrapping head along said first portion of said wrapping path so as to move said seat into said perpendicular position.

3. The wrapping method of claim 1 wherein, said lateral walls being movable between an open first position and a closed second position; said two lateral walls being maintained in said first position during said supply step and subsequently being moved into said second position to hold together said sheet of wrapping material and said product cigarette group thereby.

4. The wrapping method of claim 1, wherein said wrapping path is a circular path extending about a fixed axis.

5. The wrapping method of claim 1 wherein said cigarette group is inserted by a gripping device of a supply unit for supplying said seat with said cigarette group, said gripping device being inserted inside said seat together with said cigarette group.

6. The wrapping method of claim 5 further comprising the step of releasing said cigarette group from said seat simultaneously with activation of a folding device carried by said supply unit for folding a wing of said U-folded sheet of wrapping material onto said cigarette group.

7. A method of wrapping a cigarette group in a sheet of wrapping material, the method comprising the steps of:

continuously feeding a wrapping head along a wrapping path having first and second portions, said wrapping head having a seat for a cigarette group that is positioned along said first portion to receive said cigarette group therein, said seat including a bottom wall and two lateral walls, said lateral walls being movable between an open first position and a closed second position;

supplying said seat with said sheet of wrapping material and said cigarette group along said first portion such that said sheet of wrapping material is fed to said wrapping head so as to be folded into a U inside said seat, and at least one said cigarette group is successively fed to said seat so as to be inserted inside said U-folded sheet of wrapping material; wherein said lateral walls are maintained in said first position during said supply step and subsequently being moved into said second position to hold together said sheet of wrapping material and said product cigarette group thereby.

folding said sheet of wrapping material about said cigarette group along said first portion so as to form a tubular wrapping about said cigarette group, said tubular wrapping having two opposite open ends; and feeding said seat through a fixed folding device along said second portion in which said seat is proximate and substantially parallel to said wrapping path as said seat travels therealong, thereby folding said opposite open ends of said tubular wrapping against said cigarette group along said second portion of said wrapping path;

wherein said cigarette group is inserted by a gripping device of a supply unit for supplying said seat with said cigarette group, said gripping device being inserted inside said seat together with said cigarette group, said cigarette group being released from said seat simultaneously with activation of a folding device carried by said supply unit for folding a wing of said U-folded sheet of wrapping material onto said cigarette group.

8. The wrapping method of claim 7 further comprising the step of positioning said wrapping head in said first portion of said wrapping path so that said seat extends substantially perpendicular to said wrapping path.

9. The wrapping method of claim 8 further comprising the step of oscillating said wrapping head along said first portion of said wrapping path so as to move said seat into said perpendicular position.

10. The wrapping method of claim 7, wherein said wrapping path is a circular path extending about a fixed axis.

11. A method of wrapping a cigarette group in a sheet of wrapping material, the method comprising the steps of:

continuously feeding a wrapping head along a wrapping path having first and second portions, said wrapping head having a seat for a cigarette group that is positioned along said first portion to receive said cigarette group therein;

supplying said seat with said sheet of wrapping material and said cigarette group along said first portion such that said sheet of wrapping material is fed to said wrapping head so as to be folded into a U inside said seat, and at least one said cigarette group is successively fed to said seat so as to be inserted inside said U-folded sheet of wrapping material;

folding said sheet of wrapping material about said cigarette group along said first portion so as to form a tubular wrapping about said cigarette group, said tubular wrapping having two opposite open ends; and feeding said seat through a fixed folding device along said second portion in which said seat is proximate and substantially parallel to said wrapping path as said seat travels therealong, thereby folding said opposite open ends of said tubular wrapping against said cigarette group along said second portion of said wrapping path;

wherein said cigarette group is inserted by a gripping device of a supply unit for supplying said seat with said cigarette group, said gripping device being inserted inside said seat together with said cigarette group, said cigarette group being released from said seat simultaneously with activation of a folding device carried by said supply unit for folding a wing of said U-folded sheet of wrapping material onto said cigarette group.

12. The wrapping method of claim 11 further comprising the step of positioning said wrapping head in said first portion of said wrapping path so that said seat extends substantially perpendicular to said wrapping path.

13. The wrapping method of claim 12 further comprising the step of oscillating said wrapping head along said first portion of said wrapping path so as to move said seat into said perpendicular position.

14. The wrapping method of claim 11 wherein said seat includes a bottom wall and two lateral walls, said lateral walls being movable between an open first position and a closed second position; said two lateral walls being maintained in said first position during said supply step and subsequently being moved into said second position to hold together said sheet of wrapping material and said product cigarette group thereby.

15. The wrapping method of claim 11, wherein said wrapping path is a circular path extending about a fixed axis.

* * * * *